US007311462B2

(12) United States Patent
Kervoalen

(10) Patent No.: US 7,311,462 B2
(45) Date of Patent: Dec. 25, 2007

(54) DEVICE FOR PACKAGING AND APPLYING A COSMETIC PRODUCT

(75) Inventor: Christian Kervoalen, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 11/315,368

(22) Filed: Dec. 23, 2005

(65) Prior Publication Data

US 2006/0165475 A1 Jul. 27, 2006

Related U.S. Application Data

(60) Provisional application No. 60/672,554, filed on Apr. 19, 2005.

(30) Foreign Application Priority Data

Dec. 23, 2004 (FR) ..... 04 53215
Mar. 10, 2005 (FR) ..... 05 50634

(51) Int. Cl.
*B43K 7/00* (2006.01)
*B43K 23/08* (2006.01)
*B43K 7/10* (2006.01)

(52) U.S. Cl. ..... 401/216; 401/209; 401/213

(58) Field of Classification Search ..... 401/208, 401/209, 213, 214, 216
See application file for complete search history.

(56) References Cited

U.S. PATENT DOCUMENTS 4,221,495 A 9/1980 Braun et al.
5,553,957 A * 9/1996 Dornbusch et al. ..... 401/209
6,511,243 B2 * 1/2003 Miranda ..... 401/213
2002/0044818 A1 4/2002 Renato

FOREIGN PATENT DOCUMENTS

| | | |
|---|---|---|
| CA | 1 207 278 A1 | 7/1986 |
| DE | 90 12 721 | 1/1992 |
| EP | 0528 265 | 2/1993 |
| GB | 2 044 683 | 10/1980 |

* cited by examiner

*Primary Examiner*—David J. Walczak
(74) *Attorney, Agent, or Firm*—Oblon, Spivak, McClelland, Maier & Neustadt, P.C.

(57) ABSTRACT

A device for packaging and applying a cosmetic product includes a container having a sidewall of which one edge delineates an opening. An annular portion of the sidewall forms a seating designed to house an applicator ball, mounted freely in rotation inside the seating. An inner surface of the seating includes at least one annular sealing zone on which at least one annular portion of the applicator ball is designed to bear in a leaktight manner. A cap is designed to cover an applicator portion of the ball, with the cap incorporating a bearing structure which, in the mounted position of the cap on the container, presses the ball in a leaktight manner against said annular sealing zone.

28 Claims, 1 Drawing Sheet

DEVICE FOR PACKAGING AND APPLYING A COSMETIC PRODUCT

CROSS-REFERENCE TO RELATED APPLICATIONS

This document claims priority to French Application No. 04 53215, filed Dec. 23, 2004, French Application No. 05 50634, filed Mar. 10, 2005 and U.S. Provisional Application No. 60/672,554, filed Apr. 19, 2005, the entire content of which is hereby incorporated by reference.

BACKGROUND OF THE INVENTION

1. Field of the Invention

The invention relates to a "roll on" type packaging and applicator device. The invention can be used for packaging and applying cosmetic products, for example, body hygiene products.

2. Discussion of Background

Packaging and applicator devices with "roll on" type applicator structure include a ball, most often spherical, mounted so as to rotate freely on itself, in a seating having a counterpart shape, surmounting a container holding the product to be applied. The seating includes a first opening to facilitate communication between a first surface portion of the ball and the product held in the container, and a second opening through which a second surface portion of the ball emerges to the outside.

Upon application, after removing the cap, the consumer turns the container to the upside down position so as to bring the product into contact by gravity with the first surface portion of the ball.

By virtue of the engagement between the second surface portion of the ball and the surface to be treated, and by an appropriate movement of the device relative to the surface, the ball is caused to rotate on itself thereby placing the first portion of the ball against the second opening, thus depositing the product on the surface to be treated.

Generally, the container is obtained by blow molding a material such as a rigid polypropylene, an acrylobutadiene styrene (ABS), or a high density polyethylene. The applicator ball can be made of polyethylene for example.

Typically, these devices are fitted with a removable cap which, when it is resting on the ball, presses the latter in a leaktight manner against an edge delineating the first opening thereby imparting a certain sealing action, thus breaking the liquid communication between the container and the seating containing the applicator ball.

Such devices using a spherical ball are extensively described in the patent literature.

They are widely used for packaging and applying body deodorants, or powders for use on the body.

For example, document EP 0 528 265 describes a device of this type which includes, on the one hand, a container and, on the other hand, a holder for the ball which is attached the container. The device includes a removable cap which presses the ball in a leaktight manner against two sealing lips provided on the inner surface of the holder defining the seating for the ball, thereby breaking the liquid communication between the container and the seating containing the applicator ball. The two sealing lips are relatively long so that they tend to distort when they are constrained by the cap, and tend in particular to flex outwardly. The lips thus have a tendency to "memorize" the distortion to which they are subjected when the cap is in the closed position, so that the sealing tightness is thereby diminished.

Document GB 2 044 683 also describes a device using a spherical ball which includes, on the one hand, a container for the product in the form of a tube and, on the other hand, a housing for the ball, with the housing being attached to the tube.

SUMMARY OF THE INVENTION

One of the objects of the invention is to provide a device of the type referred to above, which is simple and economic to produce, and which enables a good level of leaktightness to be achieved between the applicator structure, which includes a ball and the container holding the product to be applied.

The invention relates more particularly to devices of the type referred to above in which the seating for the ball is obtained by molding with the rest of the container.

These objects can be achieved by a device for packaging and applying a cosmetic product according to an example of the invention, which includes a container having a portion designed to contain the product, and designed to be placed in fluid communication with a seating obtained by molding with the portion, with the seating containing a spherical ball mounted freely in rotation inside the seating. An applicator portion of the ball emerges outwardly from the container through an opening formed by an edge of the seating. In addition, a cap is designed to cover the applicator portion of the ball. When the cap is mounted on the container, it presses the ball in a leaktight manner against at least two annular sealing zones formed by an inner surface of the seating, and an annular zone of the inner surface located between the two sealing zones is not in contact with the ball when the latter is bearing in a leaktight manner against the two annular sealing zones.

According to an example embodiment, the two annular sealing zones can be formed by ridges or lips obtained by molding with the seating.

By way of example, the cap can include a bearing structure which, when the cap is fitted, engages with the ball. The bearing structure can include two concentric skirts, centered on an axis X of the container. The bearing structure can include an inner skirt and an outer skirt, with the outer skirt participating in the alignment of the ball in its seating, and having a lower stiffness than the inner skirt.

The cap can be screwed onto the container, for example.

The two annular zones can be located on the same side of a median plane of the applicator ball perpendicular to a lengthwise axis X of the container, and at a distance from the median plane.

Also by way of example, the container, the applicator ball and the cap can be made from at least one thermoplastic material selected from polyolefins, in particular polypropylene, high or low density polyethylene, or mixtures thereof.

When the ball is bearing in a leaktight manner against the annular sealing zones, the annular sealing zones are at least partially deformed/compressed under the pressure of the applicator ball.

By way of example, the product can be a body hygiene product, in particular a deodorant, or a contouring product.

According to an example embodiment, the sidewall of the seating housing the ball can have a diminishing thickness in the direction of the opening.

According to another example of the invention, independently or in combination with the foregoing, a device for packaging and applying a cosmetic product is provided which includes a container having a sidewall of which an edge delineates an opening, with an annular portion of the sidewall, adjacent to the opening, forming a seating containing a spherical ball mounted freely in rotation inside the seating. The seating can be obtained by molding with a portion of the container designed to hold the product, and an applicator portion of the ball emerges outwardly from the container through the opening. An inner surface of the seating has at least one annular sealing zone on which at least one annular portion of the ball is designed to bear in a leaktight manner and in which the width, in a direction perpendicular to an axis X of the container, of an annular space between the ball and the inner surface of its seating diminishes continuously between an annular sealing zone on which the ball is bearing in a leaktight manner and the edge delineating the opening. In addition, a cap is provided which, when it is mounted on the container, presses the ball in a leaktight manner against the annular zone.

By way of example, the annular sealing zone can be formed by a ridge. The annular sealing zone(s) can be formed in the vicinity of a constriction zone separating the portion designed to contain the product from the seating containing the ball.

Other objects will become apparent in a detailed manner upon reading the detailed description which follows.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

Other characteristics and advantages of the invention will become apparent from the following detailed description, particularly when considered in conjunction with the drawings in which.

DETAILED DESCRIPTION OF THE PREFERRED EMBODIMENTS

Figure 1:
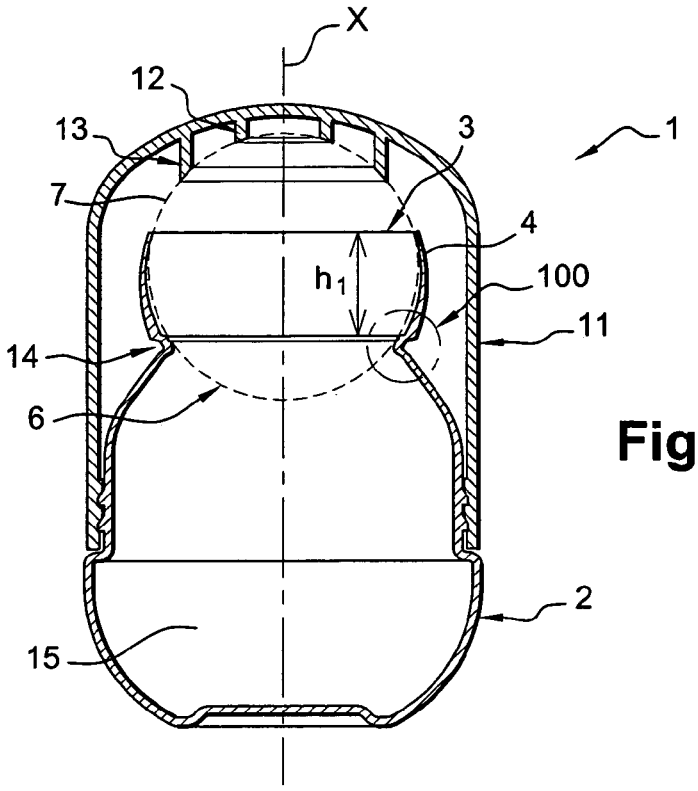
FIG. 1 is an overall view of the device in cross-section.
Figure 2:
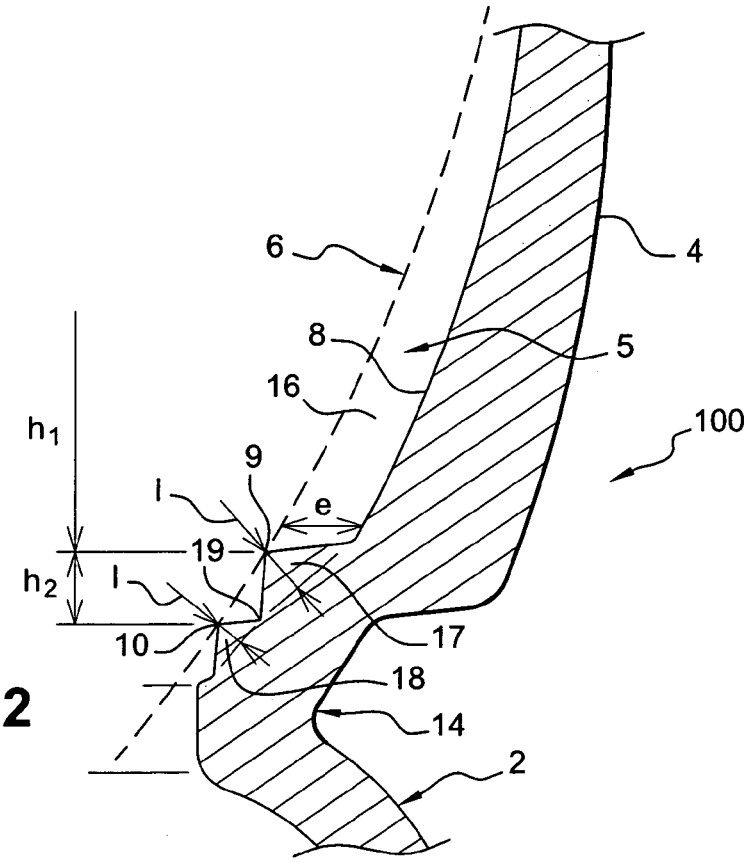
FIG. 2 presents a view in detail of the sealing zone between the ball and the container.

By way of example, FIGS. 1 and 2 to which reference is now made depict a packaging and applicator device 1 for a cosmetic product according to a preferred embodiment of the invention.

In this particular embodiment the packaging and applicator device 1 includes a container 2 having a portion 15 forming a reservoir designed to contain the product.

The portion 15 is designed to be placed in fluid communication with a seating 5 obtained by molding with the portion 15, and containing a spherical ball 6 mounted freely in rotation on itself inside the seating.

Thus, as illustrated in FIGS. 1 and 2, the seating 5 has a spherical shape, truncated at its two ends on the axis X of the container 2.

An applicator portion 7 of the ball 6 emerges outwardly from the container 2 through an opening 3 formed by an edge of the seating.

The device includes a cap 11 designed to cover the applicator portion 7 of the ball. The cap 11, when it is mounted on the container, presses the ball 6 in a leaktight manner against at least two annular sealing zones 9, 10 formed by an inner surface 8 of the seating 5. An annular zone 19 of the inner surface 8 is located between the two zones 9, 10 and the zone 19 is not pressed by the ball when the ball is bearing in a leaktight manner on the two annular sealing zones 9, 10.

As can be clearly seen in FIGS. 1 and 2, the two annular zones 9, 10 are located on the same side of a median plane of the applicator ball 6 perpendicular to a lengthwise axis X of the container, and at a distance from the median plane.

Specifically, the ridges 9 and 10 are formed at (or at least in the near vicinity of) a constriction zone 14 separating the part 15 of the container holding the product from the seating 5 containing the applicator ball 6. The space of the seating 5 located under the ball is thus reduced, or null, thereby limiting the zones, other than inside the portion 15 forming the reservoir, which could act as a reserve for the product and in which the product could dry out between two uses.

In the illustrated example, the two annular sealing zones are formed by ridges 9, 10 obtained by molding with the seating.

Each of the ridges 9 and 10 is formed without back-draft, at the junction of a first portion of a wall substantially parallel to the axis X and a second portion substantially perpendicular to the axis X. Thus, the ridges are formed at the apex of rings of material 17, 18, of which the radial width 1 can be between 0.5 and 1 mm. Although the ridges are shown as somewhat sharp corners, the ridges can be more or less rounded.

Advantageously, the ridges extend in a plane or to points of a spherical surface of which the curvature is substantially identical to the curvature of the ball 6.

In an alternative not illustrated in the drawings, sealing is accomplished by means of one or more resiliently deformable lips carried by the inner surface of the seating 5. However, this solution is less advantageous than the previous one in that it can impede the effective rotational movement of the ball inside its seating and therefore the delivery of product.

As can be seen in FIG. 1, the ball 6 is set apart from the inner surface 8 of its seating 5 on an annular portion. In particular, the width perpendicular to the axis X of the annular space 16 between the ball 6 and the inner surface 8 of its seating diminishes continuously between the ridge 9 with which the ball is in leaktight bearing contact and the edge delineating the opening 3. As can be seen, the gap between the ball and the inner surface 8 diminishes or decreases such that it is larger in a region closer to the interior or reservoir portion of the container and becomes progressively smaller toward the opening of the seating from which the ball protrudes. During use this configuration advantageously ensures efficient delivery of product to the applicator portion of the ball.

The cap 11 is screwed onto the container 2 and in particular onto the outer surface of the portion 15 forming the reservoir. It could alternatively be screwed onto the outer surface of the portion of the container forming the seating 5 for the ball. Of course, other modes of attachment for the cap can be utilized.

The cap 11 can include a bearing structure which, when the cap is fitted, engages with the ball 6. In the illustrated arrangement, the bearing structure includes two concentric skirts 12, 13, centered on an axis X of the container: an inner skirt 12 and an outer skirt 13, with the outer skirt participating in the alignment of the ball 6 in its seating 5, and having a lower stiffness than the inner skirt. Once the ball has engaged with the inner skirt 12, the ball ceases to be able to rotate.

As a variant, provision can be made for the cap to include only one skirt.

In a preferred embodiment, the container 2, the applicator ball 6 and the cap 11 are formed from polypropylene. Other materials can be used however. The container 2, the applicator ball 6 and the cap 11 can be made from at least one thermoplastic material selected from polyolefins, in particular polypropylene, high or low density polyethylene, or mixtures thereof.

When the ball 6 is bearing in a leaktight manner against the annular zones 9, 10, the latter are at least partially deformed/compressed under the pressure of the applicator ball 6. However, when the annular sealing zones are ridges, the amount of this deformation is relatively small.

In the case where the ridges designed to deform by compression are replaced by lips that are more resiliently deformable, in particular by flexure, the material will be selected in relation to its ability to flex resiliently.

The ridges are disposed in proximity to the constriction zone 14 separating the part 15 of the container holding the product from the seating 5, and they are situated as close as possible to the axis X. The force exerted by the ball 6 on the ridges 9 and 10 therefore has a component on the axis X, i.e. parallel to the force exerted by the cap on the ball, preferably that is as large as possible. The intensity of the force exerted by the ball on the ridges is thus greater than if the ridges were disposed closer to the median plane of the ball perpendicular to the axis X, as in this case, the force exerted by the ball on the ridges would have a larger component perpendicular to the axis X. The sealing efficiency is thus optimal.

In a particular example, the width e of the annular space 16 at the lower edge of the ridge 9 is equal to 1 mm and diminishes progressively to the edge of the seating delineating the opening 3 where the ball comes into contact with the inner surface 8. The distance h1 measured on the axis X between the ridge 9 and the edge delineating the opening 3 is approximately equal to 14 mm. The two ridges 9 and 10 are separated by a height h2 measured on the axis X approximately equal to 0.8 mm.

By way of example, the product is a body hygiene product, in particular a deodorant. As a variant, the product can be a contouring and/or firming product.

In the embodiment illustrated, the sidewall of the seating 5 housing the ball 6 has a diminishing thickness in the direction of the opening 3. By virtue of such a configuration, the wall is thin at the level of the opening thereby facilitating placement of the ball 6 in the seating 5. Furthermore, the wall is thicker towards the constriction zone 14 thereby limiting the space in the seating 5 where product could dry out between two uses.

Instead of providing two annular sealing zones, only one may be provided, preferably located as close as possible to the constriction zone 14.

By way of example, an injection blow molding process is advantageously used to make the container 2. The seating 5 extending between the opening 3 and the constriction zone 14 is injected first, with a parison extending from the constriction zone, intended to form the portion 15 designed to contain the product. The portion 15 is then obtained by blow molding the parison. The container 2 is thus obtained from a single piece.

To apply the product, the user unscrews the cap 11 so that the ball 3 is no longer pressed against the ridges 9 and 10. The user can then place the container in the upside down position so as to bring the product into contact, by gravity, with the surface portion of the ball that is facing the inside of the portion 15 forming the reservoir. The user can then apply the applicator portion 7 of the ball 6 onto the surface where he/she wishes to apply the product. The user then moves the device relative to the surface, thereby causing the ball to rotate on itself so that the portion of the ball on which the product is deposited is positioned in the region of the opening 3, thus depositing the product onto the surface to be treated.

After applying the product, the user screws the cap 11 onto the container 2 so that the skirts 12 and 13 bear against the ball 3, which itself bears in a leaktight manner on the ridges 9 and 10. The product contained in the portion forming the reservoir 15 is therefore no longer able to flow out of the container 2.

In another aspect, the invention provides a device 1 for packaging and applying a cosmetic product including a container having a sidewall of which an edge delineates an opening 3, with an annular portion 4 of the sidewall, adjacent to the opening, forming a seating 5 containing a spherical ball 6 mounted freely in rotation inside the seating. An applicator portion 7 of the ball emerges outwardly from the container 2 through the opening, and an inner surface 8 of the seating has at least one annular zone 9, 10, on which at least one annular portion of the ball 6 is designed to bear in a leaktight manner. The width perpendicular to the axis X of an annular space 16 between the ball 6 and the inner surface 8 of its seating diminishes continuously between an annular zone 9 on which the ball is bearing in a leaktight manner and the edge delineating the opening 3. In addition, a cap 11 is provided which, when it is mounted on the container, presses the ball 6 in a leaktight manner against the annular sealing zone 9, 10.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for packaging and applying a cosmetic product, the device comprising:

i) a container including a reservoir portion designed to contain the product, which is in fluid communication with a seating which is molded with the reservoir portion, said seating containing a spherical ball mounted freely in rotation inside the seating, wherein the reservoir portion is separated from the seating by a constriction zone, wherein an applicator portion of the ball emerges outwardly from the container through an opening formed by an edge of said seating, wherein the seating includes an inner surface with at least two annular sealing zones and an annular zone between the two annular sealing zones formed on said inner surface, and ii) a cap which covers the applicator portion of the ball, wherein when the cap is in a mounted position on the container, the cap presses the ball in a leaktight manner against the at least two annular sealing zones formed on the inner surface of the seating, and wherein the annular zone of said inner surface located between the two sealing zones is not in contact with the ball when the ball is bearing in a leaktight manner against the two annular sealing zones.

2. A packaging and applicator device according to claim 1, wherein the two annular sealing zones are formed by ridges or lips obtained by molding with the seating.

3. A packaging and applicator device according to claim 1, wherein the cap includes a bearing structure which, when the cap is in said mounted position, engages with the ball, and wherein the bearing structure includes two concentric skirts centered on the axis of the container.

4. A device according to claim 3, wherein the bearing structure includes an inner skirt and an outer skirt, wherein the outer skirt participates in the alignment of the ball in its seating, and wherein the outer skirt has a lower stiffness than the inner skirt.

5. A device according to claim 4, wherein the cap is screwed onto the container.

6. A device according to claim 1, wherein the container has a lengthwise axis, and wherein the two annular sealing zones are located on the same side of a median plane of the applicator ball perpendicular to the lengthwise axis of the container, and at a distance from said median plane.

7. A device according to claim 1, wherein the container, the applicator ball and the cap are made from at least one thermoplastic material selected from the group consisting of polypropylene, high density polyethylene, low density polyethylene, and mixtures thereof.

8. A device according to claim 1, wherein the container contains a body hygiene product.

9. A device according to claim 1, wherein the container contains a deodorant.

10. A device according to claim 1, wherein the container contains a contouring product.

11. A device according to claim 1, wherein said two annular sealing zones include an upper annular sealing zone and a lower annular sealing zone, and wherein a sidewall of the seating housing the ball has a continuously diminishing thickness from said upper annular sealing zone to said opening.

12. A device according to claim 1, wherein the reservoir portion is separate from the annular zone.

13. A device according to claim 1, wherein the reservoir portion is located on a side of the ball opposite to the applicator portion.

14. A device for packaging and applying a cosmetic product, the device comprising:

i) a container including a portion designed to contain the product, which is in fluid communication with a seating which is molded with the portion, said seating containing a spherical ball mounted freely in rotation inside the seating, wherein an applicator portion of the ball emerges outwardly from the container through an opening formed by an edge of said seating, wherein the seating includes an inner surface with at least two annular sealing zones and an annular zone between the two annular sealing zones formed on said inner surface, and ii) a cap which covers the applicator portion of the ball, wherein when the cap is in a mounted position on the container, the cap presses the ball in a leaktight manner against the at least two annular sealing zones formed on the inner surface of the seating, and wherein the annular zone of said inner surface located between the two sealing zones is not in contact with the ball when the ball is bearing in a leaktight manner against the two annular sealing zones, wherein when the ball is bearing in a leaktight manner against the two annular sealing zones, the two annular sealing zones are at least partially deformed by pressure exerted by the applicator ball.

15. A device for packaging and applying a cosmetic product, the device comprising:

i) a container including a portion designed to contain the product, which is in fluid communication with a seating which is molded with the portion, said seating containing a spherical ball mounted freely in rotation inside the seating, wherein an applicator portion of the ball emerges outwardly from the container through an opening formed by an edge of said seating, wherein the seating includes an inner surface with at least two annular sealing zones and an annular zone between the two annular sealing zones formed on said inner surface, and ii) a cap which covers the applicator portion of the ball, wherein when the cap is in a mounted position on the container, the cap presses the ball in a leaktight manner against the at least two annular sealing zones formed on the inner surface of the seating, and wherein the annular zone of said inner surface located between the two sealing zones is not in contact with the ball when the ball is bearing in a leaktight manner against the two annular sealing zones, wherein said two annular sealing zones include an upper annular sealing zone and a lower annular sealing zone, and wherein an annular gap is provided between said ball and said inner surface in a region extending from said upper annular sealing zone to said opening, wherein said gap has a width in a direction perpendicular to an axis of said container, and wherein said width is largest at a location near said upper annular sealing zone and becomes progressively smaller toward said opening.

16. A device according to claim 15, wherein said seating comprises a sidewall having a thickness which progressively decreases in a direction toward said opening.

17. A device for packaging and applying a cosmetic product, the device including a container comprising:

i) a sidewall which includes an edge delineating an opening, wherein an annular portion of said sidewall, adjacent to the opening, forms a seating containing a spherical ball mounted freely in rotation inside the seating, wherein the seating is molded with a portion of the container designed to hold the product, wherein an applicator portion of the ball emerges outwardly from the container through said opening, wherein the seating includes an inner surface having at least one annular sealing zone on which at least one annular portion of the ball is designed to bear in a leaktight manner, and wherein a width of an annular space between the ball and the inner surface of the seating diminishes continuously from a location near an annular sealing zone on which the ball is bearing in a leaktight manner to the edge delineating said opening, wherein said width is in a direction perpendicular to an axis of said container, and wherein the annular sealing zone is at least partially delimited by a first wall portion and a second wall portion, wherein the first wall portion extends substantially parallel to said axis of said container and said second wall portion extends substantially perpendicular to said axis of said container; and ii) a cap which, in a mounted position on the container, presses the ball in a leaktight manner against said annular sealing zone.

18. A device according to claim 17, wherein the annular sealing zone is formed by a ridge.

19. A device according to claim 17, wherein the annular sealing zone is formed in the vicinity of a constriction zone separating the portion designed to contain the product from the seating containing the ball.

20. A device according to claim 17, wherein the cap includes inner and outer concentric skirts which bear against said ball when the cap is in the mounted position, and wherein said outer skirt has a lower stiffness than said inner skirt.

21. A device according to claim 17, wherein said first and second wall portions meet with each other to form the annular sealing zone.

22. A device according to claim 17, wherein the at least one annular sealing zone comprises an upper annular sealing zone and a lower annular sealing zone, each including respective first and second wall portions, and wherein the first wall portion of the upper annular sealing zone meets with the second wall portion of the lower annular sealing zone to form an annular zone between the upper and lower annular sealing zones.

23. A device for packaging and applying a cosmetic product, the device including a container comprising:

i) a sidewall which includes an edge delineating an opening, wherein an annular portion of said sidewall, adjacent to the opening, forms a seating containing a spherical ball mounted freely in rotation inside the seating, wherein the seating is molded with a portion of the container designed to hold the product, wherein an applicator portion of the ball emerges outwardly from the container through said opening, wherein the seating includes an inner surface having at least one annular sealing zone on which at least one annular portion of the ball is designed to bear in a leaktight manner, and wherein a width of an annular space between the ball and the inner surface of the seating diminishes continuously from a location near an annular sealing zone on which the ball is bearing in a leaktight manner to the edge delineating said opening, and wherein said width is in a direction perpendicular to an axis of said container;

ii) a cap which, in a mounted position on the container, presses the ball in a leaktight manner against said annular sealing zone; and wherein a plurality of annular sealing zones are provided on the inner surface of said seating.

24. A device according to claim 23, wherein the plurality of annular sealing zones are each formed as annular rings having a first wall portion extending substantially parallel to the axis of said container and a second wall portion extending substantially perpendicular to said axis, and wherein said first and second wall portions form ridges at a juncture therebetween.

25. A device according to claim 24, wherein the first wall portion of one of said annular sealing zones meets with the second wall portion of another of said annular sealing zones to form a juncture therebetween.

26. A device for packaging and applying a cosmetic product, the device comprising:

i) a container including a portion designed to contain the product, which is in fluid communication with a seating which is molded with the portion, said seating containing a spherical ball mounted freely in rotation inside the seating, wherein an applicator portion of the ball emerges outwardly from the container through an opening formed by an edge of said seating, wherein the seating includes an inner surface with at least two annular sealing zones and an annular zone between the two annular sealing zones formed on said inner surface, and ii) a cap which covers the applicator portion of the ball, wherein when the cap is in a mounted position on the container, the cap presses the ball in a leaktight manner against the at least two annular sealing zones formed on the inner surface of the seating, and wherein the annular zone of said inner surface located between the two sealing zones is not in contact with the ball when the ball is bearing in a leaktight manner against the two annular sealing zones, wherein each of the two annular sealing zones is at least partially delimited by a first wall portion and a second wall portion, wherein the first wall portion extends substantially parallel to an axis of said container and wherein said second wall portion extends substantially perpendicular to said axis.

27. A device according to claim 26, wherein said annular zone is at least partially delimited by the first wall portion of one of the two annular sealing zones and the second wall portion of the other of the two annular sealing zones.

28. A device according to claim 27, wherein the first wall portion of said one of the two annular sealing zones extends to and meets the second wall portion of the other of the two annular sealing zones to form a juncture therebetween, and wherein the respective first and second wall portions of each of the two annular sealing zones meet with each other to form a juncture therebetween.

* * * * *